United States Patent [19]

Wossler

[11] 4,177,983

[45] Dec. 11, 1979

[54] DEVICE FOR PICKING UP, DEPOSITING AND TRANSPORTING THIN METAL FOILS BY MEANS OF A VACUUM LIFTING DEVICE

[75] Inventor: Manfred Wossler, Munich, Fed. Rep. of Germany

[73] Assignee: Siemens Aktiengesellschaft, Berlin & Munich, Fed. Rep. of Germany

[21] Appl. No.: 863,042

[22] Filed: Dec. 21, 1977

[30] Foreign Application Priority Data

Dec. 29, 1976 [DE] Fed. Rep. of Germany ..... 2659421

[51] Int. Cl.[2] ..... B65H 5/10

[52] U.S. Cl. ..... 271/268; 271/106; 271/194

[58] Field of Search ..... 271/14, 11, 267, 268, 271/264, 20, 194, 84, 85, 106, 12, 13, 15, 5, 3, 269, 18.1, 18.2, 277; 214/1 BT, 1 S, 8.5 D; 101/287

[56] References Cited

U.S. PATENT DOCUMENTS

| | | | |
|---|---|---|---|
| 406,059 | 7/1889 | Orser | 271/5 |
| 2,565,459 | 8/1951 | Willett | 271/3 X |
| 2,849,231 | 8/1958 | Reguly et al. | 271/11 |
| 2,950,914 | 8/1960 | Golding | 271/277 |

FOREIGN PATENT DOCUMENTS

| | | | |
|---|---|---|---|
| 2432349 | 2/1975 | Fed. Rep. of Germany | 271/12 |
| 2364548 | 6/1975 | Fed. Rep. of Germany | 271/106 |

*Primary Examiner*—Bruce H. Stoner, Jr.

*Attorney, Agent, or Firm*—Hill, Van Santen, Steadman, Chiara & Simpson

[57] ABSTRACT

A system is disclosed for picking up, depositing and transporting thin foils by use of a vacuum lifting device. The vacuum lifting device is conveyed on a traverse from a foil receiving station to a foil depositing station. At the depositing station a transport frame is provided on guide rails to permit conveyance to a processing station. At the receiving station the vacuum lifting device picks up the foil by suction at a central region of the foil such that the foil will be suspended in a curved fashion from the vacuum lifting device. At the depositing station, the vacuum lifting device is lowered so as to permit ends of the foil which are downwardly extending on both sides of the vacuum lifting device to be pushed beneath open foil clamps on the transport frame. Subsequently the clamps are closed and the foil is maintained in an extended, wrinkle free arrangement for conveyance to the processing station.

10 Claims, 6 Drawing Figures

DEVICE FOR PICKING UP, DEPOSITING AND TRANSPORTING THIN METAL FOILS BY MEANS OF A VACUUM LIFTING DEVICE

BACKGROUND OF THE INVENTION

The invention relates to a device for picking up, depositing, and transporting thin metal foil sheets by means of a vacuum lifting device and a transport frame which supports the foils.

Vacuum lifting devices are used widely and in manifold arrangements in machines which process paper and synthetic films. However, in the handling of metal foil sheets having a thickness of 2 to $5\times10^{-2}$ mm, a particular problem consists in that very thin foils of this kind easily curl up when lifted. This is due to the fact that during the rolling of the metal foils, material tensions arise, particularly in the surface zone, and promote a curling or warping of the foils. Even slight movements of air, and likewise the environmental temperature and the atmospheric moisture influence the behavior of the very thin metal foil held on the vacuum lifting device. Under the described conditions it is difficult to deposit a foil flat, for example onto a frame, so as to enable the foil to be transported from one processing station to another. The foil sheets which are to be etched are coated on both sides with a photo-lacquer. They generally bear a plurality of similar motifs which are arranged in rows and columns on the photo-lacquer layer of the foil. A foil of this kind is referred to as a motif mat. The motifs cut out of the motif mat following etching are the motif foils.

In order that the motif mat may be passed through the etching baths, it is necessary for the foil to be elongated and flat (i.e. free from undulations) on the transport frame.

SUMMARY OF THE INVENTION

It is an object of the invention to provide a device that picks up a metal foil sheet positioned on a base, e.g. a cutting device, which avoids any curling, and which conveys the sheet to a transport frame and deposits it flat on the latter. The transport frame is to be designed to maintain the foil sheet in this position. This object is realized in accordance with the invention in that at the foil receiving station, the vacuum lifting device picks up and lifts the foil at a central region in such manner that the foil is suspended in curved form on the vacuum lifting device. When the foil is deposited, due to the lowering of the suction lifting device onto the transport frame, the ends of the foil extending on both sides of the suction lifting device are pushed beneath open foil clamps on the transport frame. The foil clamps are then closed when the foil is elongated and flat.

The fact that the foil is picked up at its central region gives rise to tensile stresses on the top surface of the foil and compressive stresses on the underside of the foil which serve to prevent the thin metal foil from curling. When the foil held in this way on the vacuum lifting device is lowered, on contact with the bearing surface of the frame the edge portions of the foil ends suspended in curved fashion become flattened with an increasing lowering stroke of the vacuum lifting device. During the flattening, the ends of the foil are pushed beneath the open foil clamps on the frame. As soon as the vacuum lifting device has reached the level of the frame surface during the lowering stroke, the foil rests upon the frame surface of the transport frame in flat state.

Now the foil clamps close and fix the foil flat within the frame. When the vacuum lifting device has been ventilated, the latter can be returned to the receiving station to pick up a further foil.

In accordance with a further feature of the invention, the vacuum lifting device is hoisted so as to be able to be carried in a traverse. The vacuum lifting device consists of a suction body which is connected to a vacuum line and which is surrounded by a mobile foil curver arranged so as to be able to be hoisted to the traverse. The foil curver which surrounds the suction body has a radius of curvature which is somewhat smaller than the radius of curvature of the foil which forms naturally as a result of the foil being centrally suspended on the suction body. This ensures that when the suction body is drawn to a peak of the curvature of the foil curver, the foil bevels against the walls of the foil curver. The foil curver protects the suspended foil from possible air flow. It also prevents the foil from curling up during the transportation and depositing process. The suction body and foil curver of the suction pick-up device each have a lifting mechanism such that they can be moved relative to one another. Advantageously, the foil clamps provided on the transport frame consist of leaf springs which can be brought from an open and into a closed position by means of rams likewise arranged on the transport frame. In known manner, the rams can be actuated by pneumatic adjusting elements or be wedge-shaped slides which are arranged inside the transport path of the frame and engage under the rams.

DESCRIPTION OF THE PREFERRED EMBODIMENTS

Figure 1:
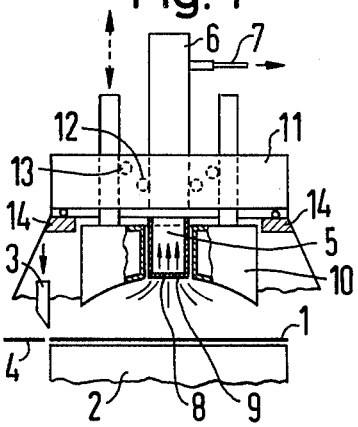
FIG. 1 is a side view of a system of the invention showing a vacuum pick-up device at a receiving station.

A motif mat which is coated with a photo-lacquer and consists of a metallic foil 1 is arranged on a cutting table 2. The foil 1 has been separated from a foil strip 4 by means of a cutting blade 3 and cut to predetermined dimensions. Precisely centrally above the cutting table 2 is arranged the vacuum pick-up device generally shown at 5. This vacuum pick-up device consists of a suction body 6, e.g. a hollow cylinder which is connected via a suction line 7 to a vacuum container which has not been shown here. On the end surface 8 of the suction body are arranged a number of nozzles 9. The suction body is surrounded by a foil curver 10. Both the suction body and the foil curver are held in a traverse 11. An adjusting mechanism 12, 13—here symbolically represented by adjusting wheels—facilitates a vertical motion of the suction body and, independently thereof, the foil curver. The traverse 11 can be displaced in the direction at right angles to the drawing plane on cross-bars 14.

Figure 2:
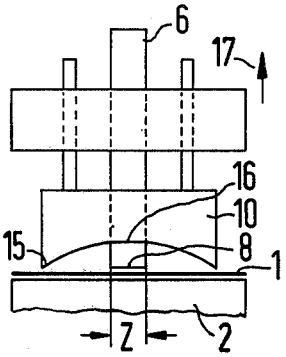
FIG. 2 is a side view of the receiving station shown in FIG. 1 but with the vacuum lifting device in a downward position.

As can be seen from FIG. 2, to enable the foil 1 to be lifted from the cutting table 2, the suction body 6 is lowered onto the plane of the foils. Likewise the foil curver 10 is adjusted over the foil in such manner that the edges 15 are positioned close above the foil. Then the vacuum is switched on so that now the central region Z of the foil is suspended on the suction surface 8 of the suction body. By means of the adjusting device 12, the vacuum pick-up device 6 is now raised until its suction surface 8 forms a tangent with the peak portion 16 of the foil curver. Thereafter the vertical movement in the direction of the arrow 17 of the suction body and of the foil curver is carried out together.

Figure 3:
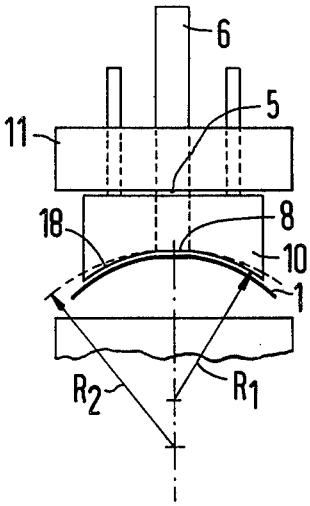
FIG. 3 is a side view of the vacuum lifting device in an upward position and illustrating different curvature radii for a curver portion of the vacuum lifting device with respect to the curve assumed by the foil in free suspension.

As can further be seen from FIG. 3, the radius R 1 of the foil curver 10 is somewhat smaller than the radius of curvature R 2 which forms naturally (here shown only in broken lines) when the foil 1 is loosely suspended on the suction surface 8 of the suction body 6. This measure ensures that the foil 1 lies flush against the bearing surface 18 of the foil curver. The foil curver protects the suspended foil from possible air flow. The foil can now be transported by means of the vacuum pick-up device 5. During the transportation, the traverse 11 moves at right angles to the drawing plane.

Figure 4:
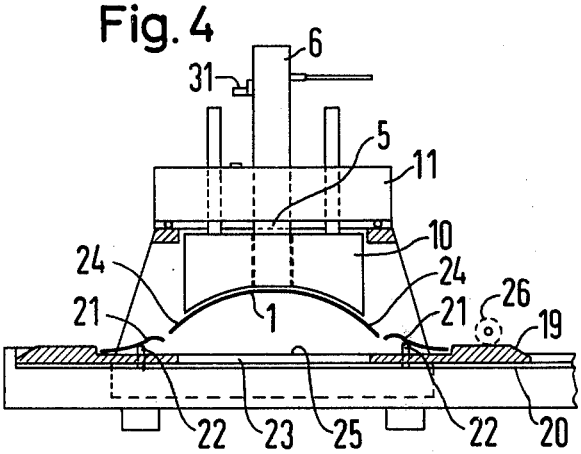
FIG. 4 is a side view of the vacuum lifting device at a depositing station.

FIG. 4 illustrates the vacuum pick-up device which has been positioned over the depositing station by means of the traverse 11. The pick-up device is positioned above a transport frame 19. The transport frame is conveyed over a frame guide rail 20 with a sliding motion. The transport frame is provided with foil clamps 21 which are held in their open position by means of rams 22. The transport frame 19 is positioned in such a way that the free frame opening 23 necessary to allow the foil to be handled is centrally positioned beneath the vacuum lifting device 5. In this state, the suction body and the foil curver by which it is surrounded are now lowered until the freely projecting foil edges 24 contact with the transport plate plane 25. Then the lowering motion of the foil curver is halted and—as illustrated in FIG. 2—only the suction body 6 is lowered until it forms contact with the plate plane 25. The foil now extends over the plane 25 of the transport frame. The suction body is ventilated so that now the foil rests freely upon the transport frame. Virtually simultaneously, the rams 22 are withdrawn so that the spring clamps 21 press against the foil and hold these fast against the transport frame. When transport rollers 26 are set in operation, the transport frame together with the foil is now brought to the processing station.

Figure 5:
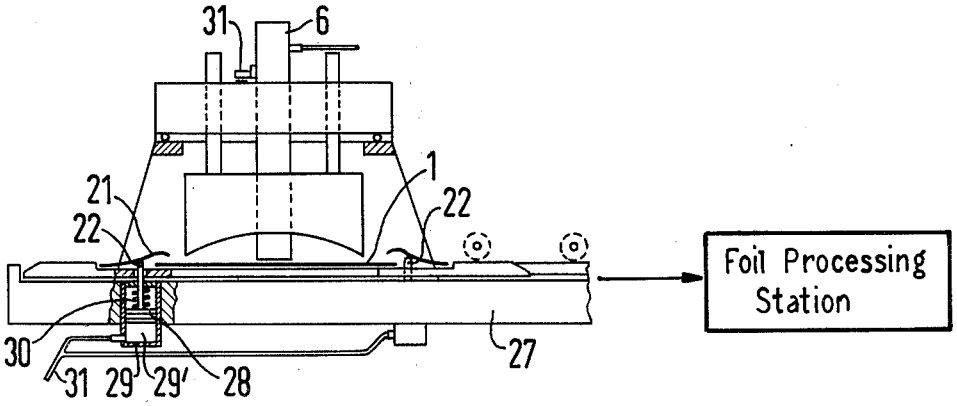
FIG. 5 is a side view of the vacuum device at the depositing station shown in FIG. 4 but with the vacuum device in a downward position.

FIG. 5 illustrates the position of the vacuum lifting device when the foil 1 is deposited onto the transport frame. In the example, the rams 22 which hold the spring clamps 21 in their secure position are arranged in a table 27 which supports the device. The raising of the rams takes place pneumatically by means of a piston 28 which is arranged in a lifting cylinder 29 and is subject to the load of a return spring 30. When the cylinder chamber 29' is evacuated, the rams 22 allow the spring clamps 21 to close. The compressed air control here is provided by a control device which has not been illustrated and by means of valves arranged in the line branch 31. The arrangement is such that under the control of the branch 31, when the suction body 6 reaches its lower end position as illustrated, a signal is given to the control device to evacuate the lifting chamber 29 and thus to reset the rams 22.

Figure 6:
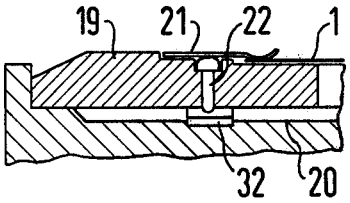
FIG. 6 is a fragmentary cross-sectional view illustrating components for automatic upward biasing of foil retaining clamps on a transport frame at the depositing station.

FIG. 6 illustrates another possibility of actuating the rams 22 in order to raise the spring clamps 21. In the present example, the rams are held within the transport frame 19. Transversely to the direction of movement of the transport frame 1, an adjusting component 32 is arranged in the guide rail 20. As soon as the adjusting component meets the ram, the latter is raised and thus also raises the clamp spring which serves to hold the foil 1. It should also be noted that the lifting motion and lifting levels in FIGS. 4 and 5 have been magnified. In the case of a foil of the size stated in the introduction, the lifting level amounts to no more than 1 mm. However, when the rams are arranged in accordance with FIGS. 4 and 5, a considerably greater lifting path is required as here the rams must be entirely withdrawn from the foil transport frame as they would otherwise obstruct the frame transport. However, the arrangement and actuation of the rams do not constitute the subject of the present invention.

The above described device can also be used correspondingly for releasing processed, e.g. etched, motif mats from the transport frame.

Although various minor modifications may be suggested by those versed in the art, it should be understood that I wish to embody within the scope of the patent warranged hereon, all such embodiments as reasonably and properly come within the scope of my contribution to the art.

I claim as my invention:

1. A system for picking up, depositing, and transporting thin foils, comprising:

(a) a transport frame having a flat support frame and foil clamps;

(b) a vacuum pick-up device;

(c) traversing means for conveying the vacuum pick-up device from a foil receiving station to a foil depositing station;

(d) a frame guide rail supporting said transport frame at the depositing station;

(e) means for positioning the vacuum pick-up device over a central region of a foil to be picked up so that the foil is suspended in curved form when picked up by its central region;

(f) said vacuum pick-up device comprising a suction body means which is vertically movably secured to said traversing means and is connected to a vacuum line, the suction body means being surrounded by a foil curver which is likewise vertically movably secured to said traversing means, and said suction body means picking up the foil at its central region at the receiving station;

(g) means for raising and lowering the vacuum lifting device;

(h) means for opening and closing the transport frame foil clamps at the depositing station; and (i) said foil clamps being positioned on sides of the transport frame and being spaced from one another a sufficient distance to permit edges of the foil suspended in a curved form to slip thereunder when the foil is lowered onto the transport frame with the clamps in an open position whereby the foil reassumes a flat elongated position as it is lowered onto the transport frame and is locked in position when the clamps close.

2. A system as claimed in claim 1, characterized in that the suction body means and foil curver of the vacuum pick-up device each have an independent lifting mechanism means for permitting movement relative to one another.

3. A system as claimed in claim 1, characterized in that a radius of curvature of the foil curver is smaller than a radius of curvature of the suspended foil which forms naturally when the foil is suspended at its central region by the suction body means, whereby when the suction body means is drawn to a peak of the curvature of the foil curver, the foil bevels in curved form against walls of the foil curver.

4. A system as claimed in claim 1, characterized in that the foil clamps are leaf spring clamps.

5. A system as claimed in claim 1, characterized in that an adjusting component means is provided at the depositing station for the actuation of ram means for biasing the foil clamps into the open position.

6. A system as claimed in claim 1, characterized in that the frame guide rail is connected to a foil processing station.

7. A system as claimed in claim 1 in which the foil clamps are positioned an equal distance on each side of a foil location center on the transport frame.

8. A system for picking up, depositing, and transporting thin foils to a foil processing station, comprising:

(a) a foil receiving station comprising a planar surface with a foil to be picked up resting thereon;

(b) a vertically movable vacuum lifting device means for positioning over a central region of the foil to be picked up and for suspension of the foil from said central region by suction, edges of the thin suspended foil bending downwardly in curved fashion by gravitational attraction, said vacuum lifting device means including a separately movable curving means for causing additional downward curving of the suspended foil;

(c) traverse means for moving the device means and suspended foil from the receiving station to a foil depositing station;

(d) conveying means at the depositing station for conveying a transport frame means to a processing station; and (e) said transport frame means comprising a frame with first and second foil clamps at sides of the frame, and means adjacent the foil clamps for opening and closing the same.

9. The system of claim 8 in which the first and second foil clamps are at opposite sides of an aperture in the frame, said clamps being spaced from one another a distance sufficient to permit edges of the curved suspended foil to pass thereunder as the foil is lowered onto the transport frame means.

10. A system for picking up, depositing, and transporting thin foils to a foil processing station, comprising:

(a) a foil receiving station comprising a planar surface with a foil to be picked up resting thereon;

(b) a vertically movable vacuum lifting device means for positioning over a central region of the foil to be picked up and for suspension of the foil from said central region by suction, edges of the thin suspended foil bending downwardly in curved fashion by gravitational attraction, said vacuum lifting device means including a separately movable curving means for causing additional downward curving of the suspended foil; and (c) traverse means for moving the device means and suspended foil from the receiving station to a foil depositing station, said foil depositing station comprising means for supporting the foil in a flat position when the vacuum lifting device releases the foil.

* * * * *